US007010250B1

(12) United States Patent
Yahagi

(10) Patent No.: US 7,010,250 B1
(45) Date of Patent: Mar. 7, 2006

(54) DEVELOPER SUPPLYING CARTRIDGE, DEVELOPER RECEIVING CARTRIDGE, PROCESS CARTRIDGE, AND IMAGE FORMING APPARATUS

(75) Inventor: Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/718,416

(22) Filed: Nov. 24, 2000

(30) Foreign Application Priority Data

Nov. 29, 1999 (JP) ..... 11/337265
Nov. 17, 2000 (JP) ..... 2000/350621

(51) Int. Cl.
*G03G 15/08* (2006.01)

(52) U.S. Cl. ..... 399/258; 399/119; 399/262

(58) Field of Classification Search ..... 399/258, 399/260, 262, 119, 106, 112
See application file for complete search history.

(56) References Cited

U.S. PATENT DOCUMENTS 5,266,998 A * 11/1993 Lee ..... 399/119 X
5,294,963 A * 3/1994 Nakano et al. ..... 399/106
5,450,178 A * 9/1995 Kawashima et al. ..... 399/262
5,671,461 A * 9/1997 Ishii ..... 399/262
5,734,953 A 3/1998 Tatsumi ..... 399/262
5,933,691 A * 8/1999 Johroku ..... 399/262
6,023,594 A * 2/2000 Okiyama et al. ..... 399/112

FOREIGN PATENT DOCUMENTS

EP 0 604 991 7/1994
EP 0 616 268 9/1994
JP 59-5254 12/1984
JP 4-12378 1/1992
JP 5-216344 8/1993
JP 6-222664 8/1994
JP 8-286490 11/1996
JP 9-269639 10/1997

OTHER PUBLICATIONS

Patent Abstracts of Japan, vol. 161, No. 63 (P-1341), Apr. 21, 1992 (JP 4-012378).
Patent Abstracts of Japan, vol. 1998, No. 2, Jan. 30, 1998 (JP 9-269639).
Patent Abstracts of Japan, vol. 18, No. 600 (P-1826) Nov. 15, 1994 (JP 06-222664).
Patent Abstracts of Japan, vol. 17, No. 658 (P-1654) Dec. 6, 1993 (JP 05-216344).

* cited by examiner

*Primary Examiner*—Susan Lee
(74) *Attorney, Agent, or Firm*—Fitzpatrick, Cella, Harper & Scinto

(57) ABSTRACT

A developer supply cartridge detachably mountable to a main assembly of an image forming apparatus, includes a developer accommodating portion of accommodating a developer; a discharging opening for discharging the developer accommodated in the developer accommodating portion to a developer receiving opening of a developer receiving cartridge provided with a developing device for developing an electrostatic image formed on an image bearing member with the developer, the developer receiving cartridge being detachably mountable to the main assembly of the image forming apparatus; a shutter member movable between an opening position for opening the discharging opening and a closing position for closing the discharging opening; and an engaging portion for engagement with the developer receiving cartridge so as to receive, from the developer receiving cartridge, a force for moving the shutter member from the closing position to the opening position, in interrelation with relative movement between the developer supply cartridge and the developer receiving cartridge toward each other in a mounting-and-demounting direction of the developer supply cartridge relative to the main assembly of the image forming apparatus.

39 Claims, 10 Drawing Sheets

DEVELOPER SUPPLYING CARTRIDGE, DEVELOPER RECEIVING CARTRIDGE, PROCESS CARTRIDGE, AND IMAGE FORMING APPARATUS

FIELD OF THE INVENTION AND RELATED ART

The present invention relates to an image forming apparatus such as a copying machine, a laser beam printer, an LED printer, a facsimile, and the like, a developer supplying cartridge removably installable in the main assembly of an image forming apparatus, and a cartridge, such as a process cartridge, that receives developer.

An image forming apparatus, such as a copying machine, that employs an electrophotographic system has been employing a system in which an electrostatic latent image formed on a photosensitive member, such as a photosensitive drum, is visualized (developed) by adhering toner thereto with the use of a developing apparatus, and then is transferred onto a piece of a recording medium, for example, a sheet of paper.

Such an electrophotographic system is sometimes combined with a cartridge system in which a photosensitive member, a developing apparatus, and the like are integrated in the form of a cartridge removably installable in the main assembly of an image forming apparatus. According to such a cartridge system, an image forming apparatus can be maintained by a user him/herself without relying on a service person, dramatically improving operational efficiency. Thus, a cartridge system has come to be widely used.

There are differences in durability among processing portions in a process cartridge. Thus, there are some designs that employ two separate process cartridges: a developer receiving cartridge that comprises a developing apparatus and receives developer, and a developer supplying cartridge, or a toner cartridge, that supplies the developer receiving cartridge with toner. A toner cartridge is provided with a toner discharging (supplying) hole through which developer is discharged, and a toner receiving cartridge, which hereinafter will be referred to as a process cartridge, and is provided with a toner receiving hole, through which developer is received. Toner is discharged (supplied) into a process cartridge by connecting the toner discharge hole to the toner receiving hole. This arrangement, which places two groups of components different in durability in two separate shells (cartridges), makes it possible to efficiently replace components, and also contributes to cost reduction and waste reduction.

However, this design of using two independent cartridges, that is, a process cartridge and a toner cartridge, creates its own problems; for example, toner scatters through the gap between two cartridges. Thus, an additional technology has been proposed, according to which a toner cartridge and a process cartridge are enabled to be removably positioned, independently from each other, in the main assembly of an image forming apparatus, with the toner discharging hole of a toner cartridge being provided with a shutter which shuts or opens the hole, whereas the toner receiving hole of a process cartridge is provided with a member for moving the shutter on the toner cartridge side. With this configuration, as both cartridges are inserted into the main assembly of an image forming apparatus, and are securely positioned therein, a projection of the shutter moving member engages in the groove of the shutter. In this state, as the lever of the shutter moving member is manually rotated, the shutter on the cartridge side is slid by a gear.

The above described structural arrangement, however, also has a problem, that in order to connect the toner receiving hole to the toner discharging hole, a bothersome operation of manually rotating the lever must be performed.

SUMMARY OF THE INVENTION

The primary object of the present invention is to provide a developer supplying cartridge, a developer receiving cartridge, a process cartridge, and an image forming apparatus, which assure that the developer discharging hole of the developer supplying cartridge, and the developer receiving hole of the developer receiving cartridge, are easily and reliably connected to each other.

Another object of the present invention is to provide a developer supplying cartridge, a developer receiving cartridge, a process cartridge, and an image forming apparatus, which prevent developer from scattering from the developer discharging hole of the developer supplying cartridge.

Another object of the present invention is to provide a developer supplying cartridge, a developer receiving cartridge, a process cartridge, and an image forming apparatus, which are structured so that when the developer receiving cartridge or the process cartridge is not in the main assembly of the image forming apparatus, the developer discharging hole of the developer supplying cartridge remains closed with a shutter.

Another object of the present invention is to provide a developer supplying cartridge, a developer receiving cartridge, a process cartridge, and an image forming apparatus, which assure that the shutter of the developer supplying cartridge can be reliably moved regardless of the order of the installation or removal of the two cartridges.

Another object of the present invention is to provide a developer supplying cartridge, a developer receiving cartridge, a process cartridge, and an image forming apparatus, which are structured so that the movement of the shutter of the developer supplying cartridge is linked to the movement of the developer supplying cartridge and developer receiving cartridge relative to each other.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, an embodiment of the present invention, in the form of an image forming apparatus, will be described with reference to the appended drawings. This embodiment will be described with reference to an electrophotographic color printer.

{General Structure}

Figure 1:
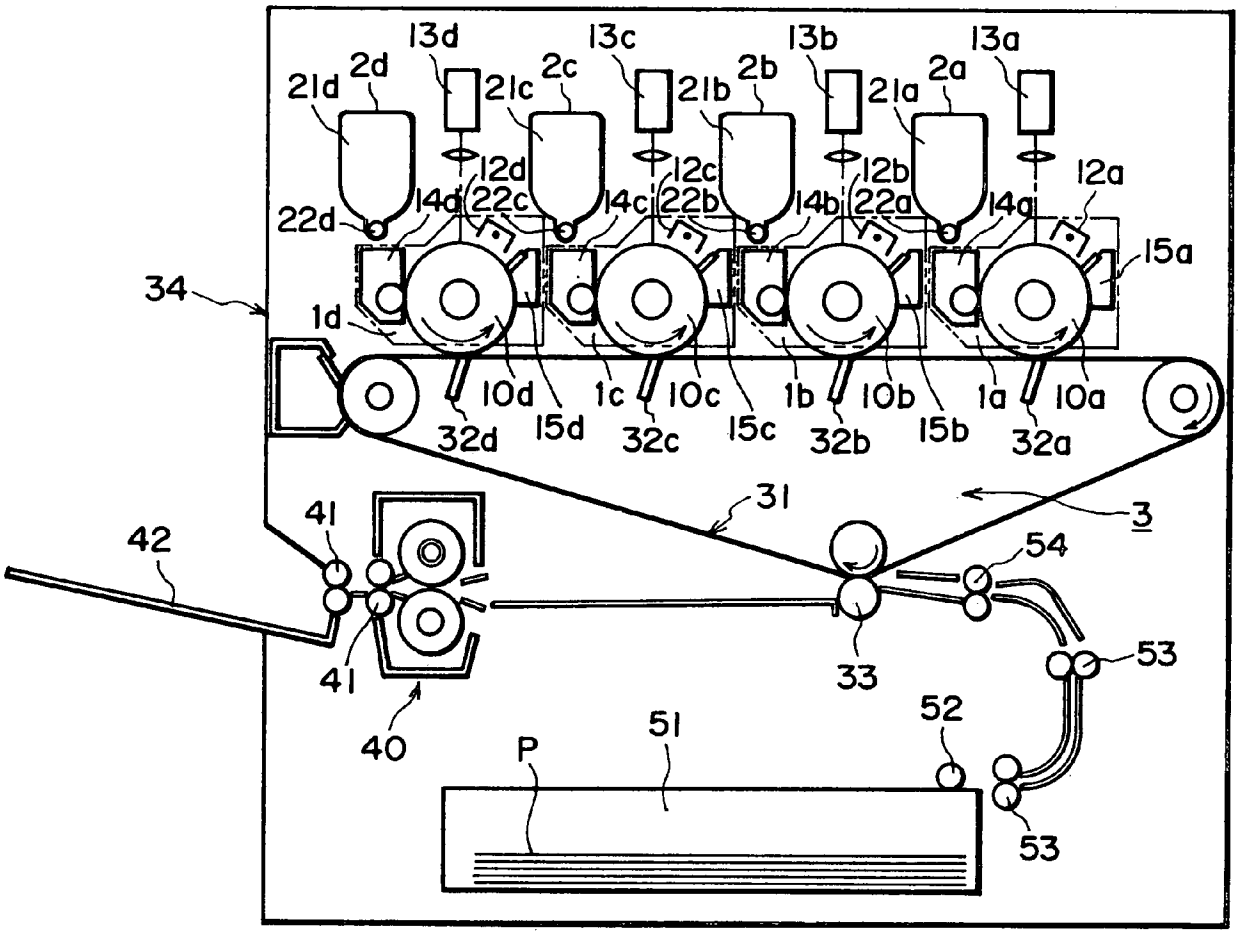
FIG. 1 is a sectional view of an image forming apparatus in accordance with the present invention, and shows the general structure of the apparatus.

First, referring to FIG. 1, the general structure of the image forming apparatus in accordance with the present invention will be described. The image forming apparatus illustrated in FIG. 1 comprises process cartridges 1*a*–1*d*, that is, developer receiving cartridges, which are removably installable, and toner cartridges 2*a*–2*d*, that is, developer supplying cartridges, which store developer (hereinafter, "toner"). The process cartridges 1*a*–1*d* are provided with photosensitive drums 10*a*–10*d*, charging apparatuses 12*a*–12*d*, exposing apparatuses 13*a*–13*d*, and developing apparatuses 14*a*–14*d*, correspondingly. The charging apparatuses 12*a*–12*d*, exposing apparatuses 13*a*–13*d*, and developing apparatuses 14*a* and 14*d* are distributed adjacent to the peripheral surface of photosensitive drums 10*a*–10*d* in the circumferential direction of the drums 10*a*–10*d*, correspondingly. Each process cartridge is removably installable in the main assembly of the image forming apparatus, independently from the other process cartridges and the toner cartridges, and each toner cartridge is removably installable in the main assembly of the image forming apparatus, independently from the other toner cartridges and the process cartridges. Each charging apparatus uniformly charges the peripheral surface of the corresponding photosensitive drum. Each exposing apparatus exposes the peripheral surface of the corresponding photosensitive drum with a laser beam modulated with image information. Each developing apparatus visualizes an electrostatic latent image formed on the corresponding photosensitive drum. The image forming apparatus is also provided with primary charging apparatuses 32*a*–32*d* for transferring the toner image on the photosensitive drum to a transfer belt 31, which is a part of an intermediary transferring means 3, and cleaning apparatuses 15*a*–15*d* for recovering the toner remaining on the peripheral surface of the corresponding photosensitive drums. Each process cartridge is provided with a photosensitive drum, a charging apparatus, a developing apparatus, and a cleaning apparatus. A developing apparatus is provided with a developer bearing member disposed adjacent to the hole of the developer container, and develops an electrostatic latent image formed on the photosensitive drum with the use of developer borne on the developer bearing member.

Placed in contact with or adjacent to the intermediary transferring means 3 are a secondary transferring apparatus 33 for transferring the toner image, which has been transferred onto the transfer belt 31, onto a piece of transfer medium P, for example, an intermediary transferring means, a cleaning apparatus 34 for recovering the toner remaining on the transfer belt 34, a fixing apparatus 40 for performing a fixing operation, a pair of discharge rollers 41 for discharging the piece of transfer medium P after the fixation of the toner image, and a delivery tray 42 in which the discharged piece of transfer medium P accumulates.

The toner storing portions 21*a*–21*d*, which are developer storing portions, store toner, that is, developer. As a toner supplying signal is sent from an unillustrated toner amount detecting means of the developing apparatus, toner supplying screws 22*a*–22*d* rotate to supply the corresponding process cartridges 1*a*–1*d* with tone.

The pieces of the aforementioned transfer medium P are placed in layers in a feeder cassette 51, and are fed out of the feeder cassette 51 one by one while being separated from the following sheets, conveyed by pairs of conveyer rollers 53 to a pair of registration rollers 54, and further conveyed in synchronism with the formation of the toner image on the photosensitive drums 10*a*–1*d*. Although only a single feeder cassette is shown in FIG. 1, the image forming apparatus may comprise two or more feeder cassettes so that pieces of transferring medium P different in size or the direction in which they are placed can be stored to enable a user to choose the desired transfer medium P. The image formation process in the above described electrophotographic color printer structured as described above is the same as that employed by a known conventional image forming apparatus.

Figure 2:
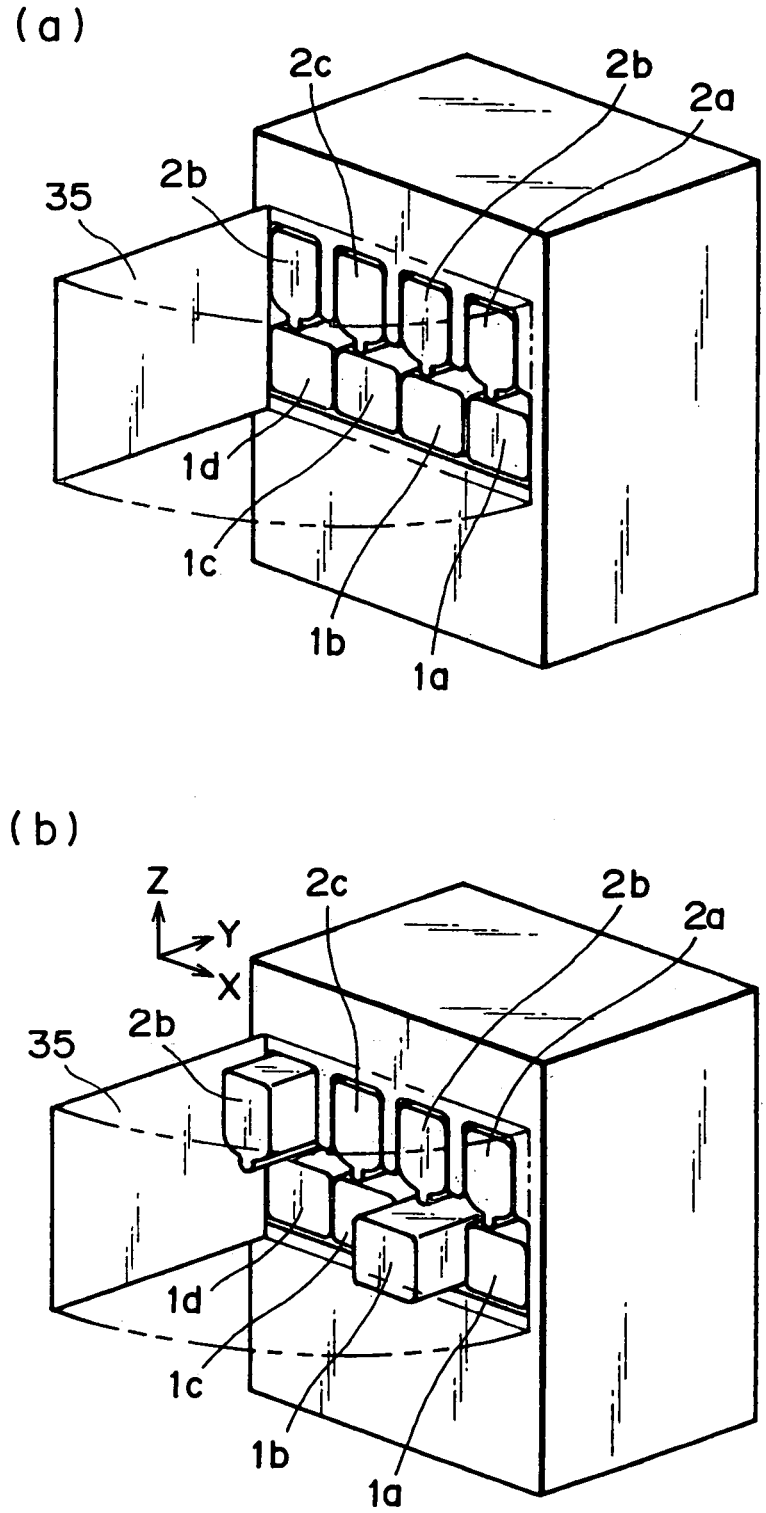
FIG. 2 is a perspective view of the image forming apparatus illustrated in FIG. 1, and also shows the general structure of the apparatus.

FIG. 2 is a schematic perspective view of the image forming apparatus in this embodiment. In FIG. 2, FIG. 2(*a*) shows the image forming apparatus, the front cover 35 of which is open. FIG. 2(*b*) shows the image forming apparatus, from which the process cartridge 1*b* and toner cartridge 2*d* have been drawn out halfway, and depicts how the process cartridges 1*a*–1*d* and toner cartridges 2*a*–2*d* might look while they are installed or removed. The process cartridges 1*a*–1*d* and toner cartridges 2*a*–2*d* are removably installed in the main assembly of the image forming apparatus, along unillustrated guide rails in the direction of the Y axis in FIG. 2(*b*).

Figure 3:
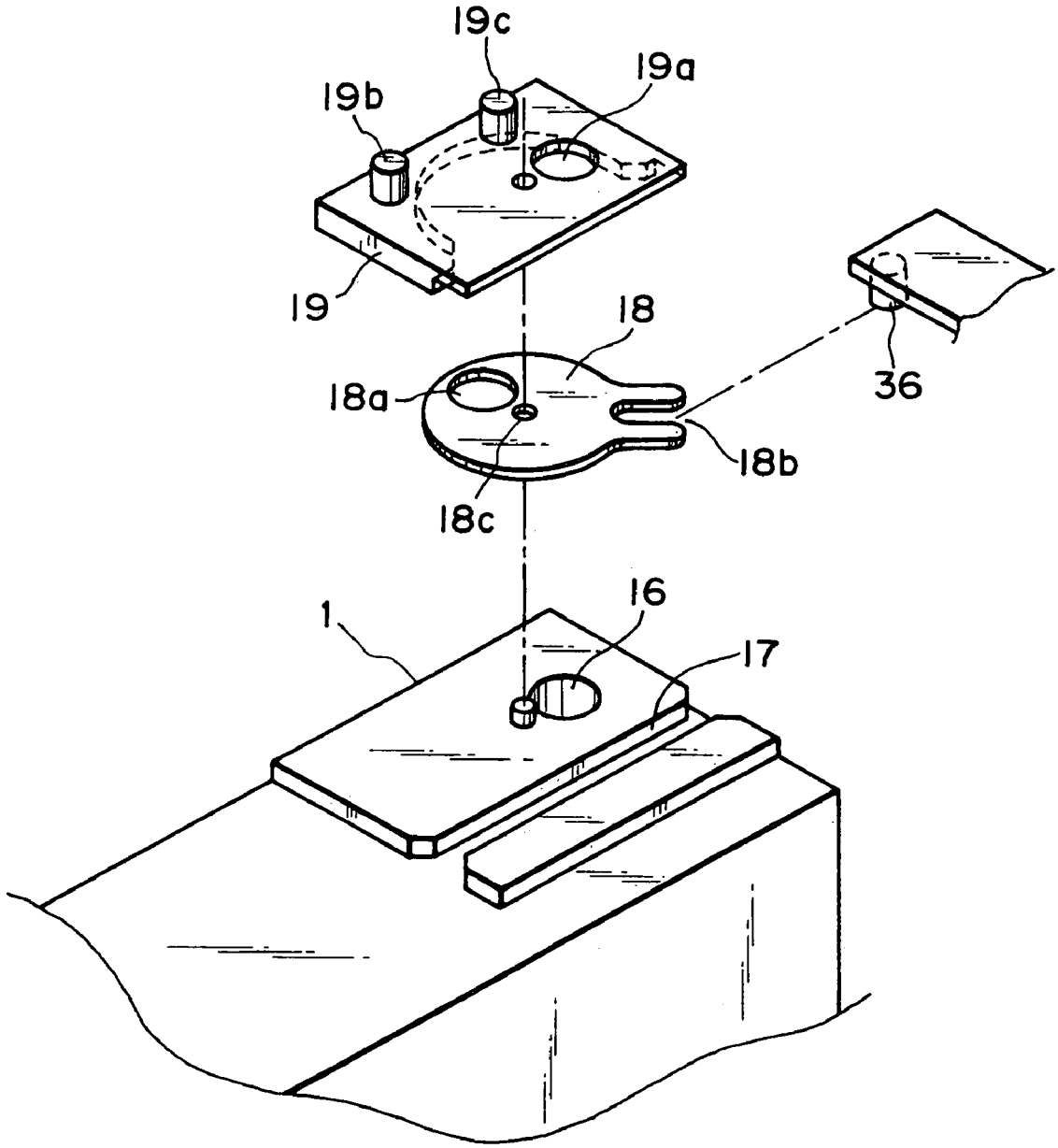
FIG. 3 is an exploded view of the shutter in the top portion of the process cartridge, that is, a second shutter, and its adjacencies.

FIG. 3 is a perspective view of the second shutter and its adjacencies in the top portion of each process cartridge. As shown in FIG. 3, each process cartridge 1 is provided with a toner receiving hole 16, which is a hole located in the top wall of the process cartridge shell 11, and through which toner is supplied into the developing apparatus. The process cartridge 1 is also provided with a second shutter 18, which is positioned to block or unblock the toner receiving hole 16, being enabled to rotate approximately 90°. The second shutter 18 is approximately round, and has a hole 18*a*, a slot 18*b*, and a center hole 18*c*. The center of the center hole 18*c* coincides with the rotational axis of the second shutter 18. The apparatus main assembly is provided with a projection 36, which is positioned so that it engages or disengages into or from the slot 18*b* in the direction in which the process cartridge is inserted into or removed from the apparatus main assembly. The process cartridge 1 is also provided with a first shutter cover 19, which is positioned on the outward side of the shutter 18, and has a hole 19*a* and two cylindrical projections 19*b* and 19*c*.

Further, each process cartridge is provided with a groove 17, which is in the top surface of the process cartridge shell, and in which the projection 36 fits to guide the process cartridge during the insertion or removal of the process cartridge 1. This arrangement reduces the amount of deviation of the process cartridge 1 and the projection 36 relative to each other in the lateral direction (direction of the axis X). FIG. 3 shows that the toner receiving hole 16 and the hole 18*a* of the second shutter 18 are not in alignment with each other; in other words, the toner receiving hole is blocked with the shutter 18.

Figure 4:
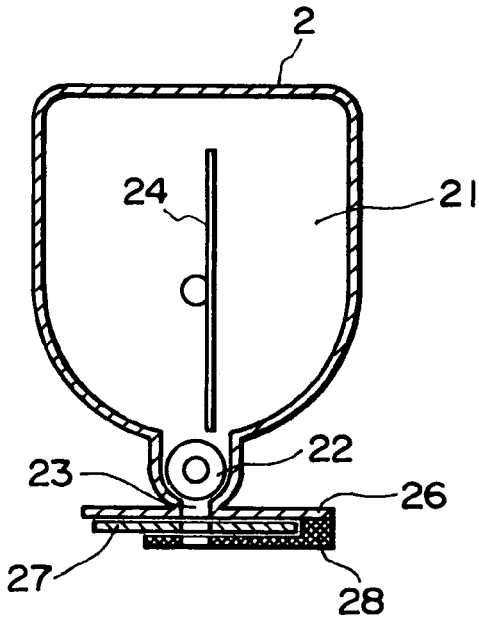
FIG. 4 is a sectional view of a toner cartridge in accordance with the present invention.

FIG. 4 is a vertical section of the toner cartridge 2 at a plane which is perpendicular to axis Y. It shows the cross sections of the toner discharging hole 23 and its adjacencies. Placed below the toner storing portion 21 is a toner supplying screw 22, and rotationally supported in the approximate center portion of the toner storing portion 21 is a stirring/conveying member 24 for efficiently sending the toner to the toner supplying screw 22. At the bottom end of the toner discharging hole 23, a rotational shutter 27, that is, a first shutter, is located, which is rotationally supported by a first shutter supporting portion 28, approximately in parallel to the bottom wall 26 of the toner containing portion 21.

Figure 5:
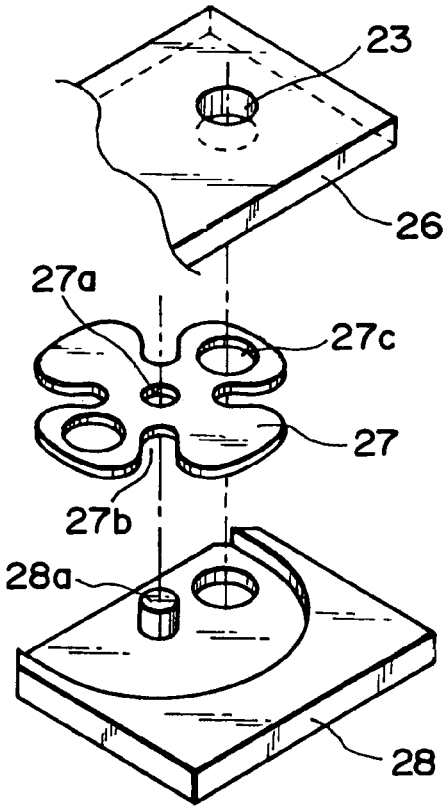
FIG. 5 is an exploded perspective view of the shutter in the toner cartridge, that is, a first shutter, in accordance with the present invention, and its adjacencies.

FIG. 5 is an exploded perspective view of the first shutter 27 and its adjacencies. The first shutter 27 is approximately circular, and has a hole 27*a* in the center. The shaft 28*a* of the first shutter supporting member 28 engages in this center hole 27*a*, allowing the first shutter 27 to rotate about the shaft 28*a*. The first shutter 27 is provided with four slots 27*b* separated by 90° from the adjacent slots. It is also provided with two holes 27*c* separated from each other by 180°.

Here, the description of the sealing member for preventing toner from scattering will be omitted. However, the gaps between the second shutter 18 and second shutter cover 19 and between the first shutter 27 and first shutter supporting member 28 may be better sealed by packing foamed urethane, felt, or the like, into the gaps.

(Operation for Installing or Removing Process Cartridge)

Figure 6:
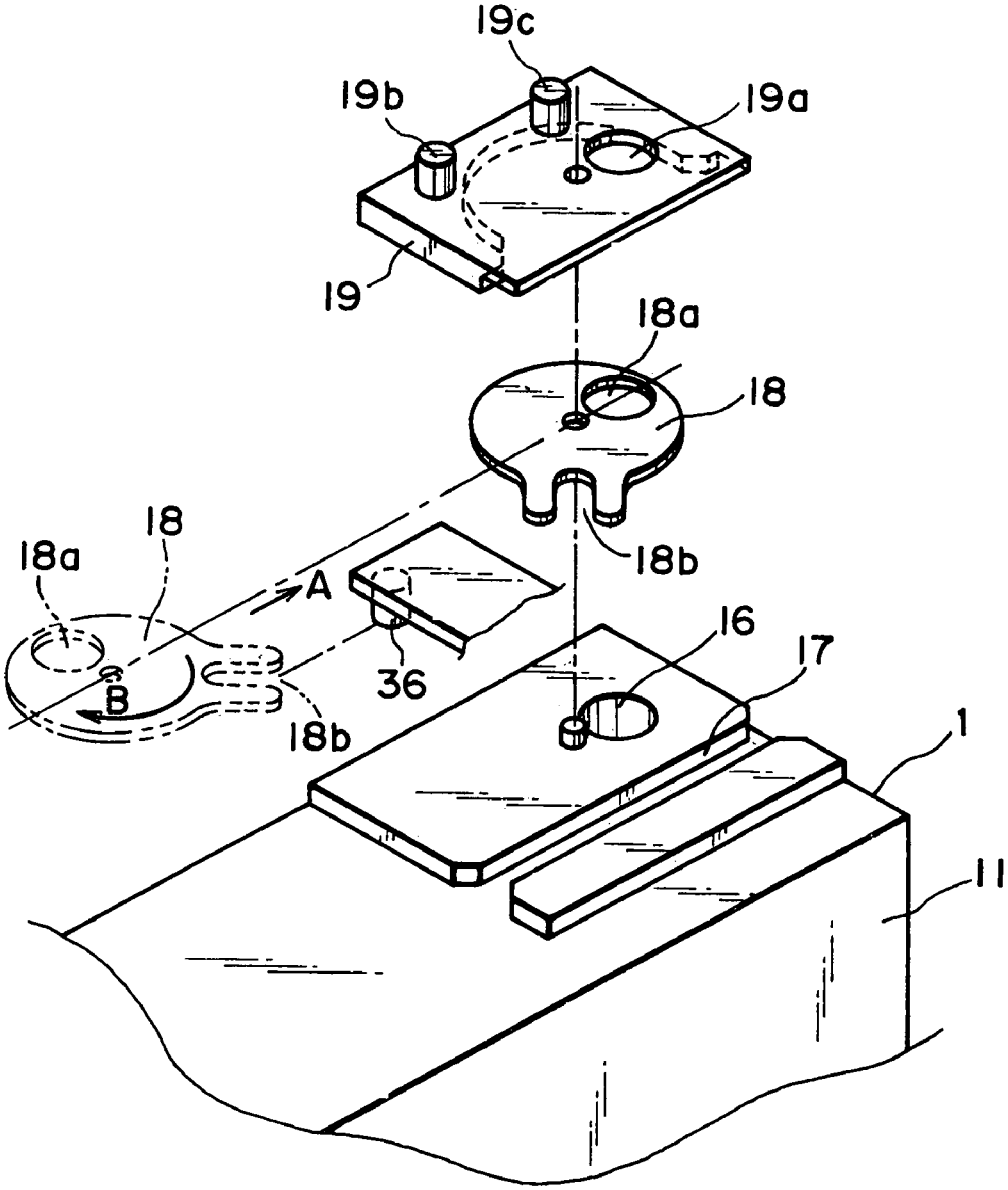
FIG. 6 is an exploded perspective view of the shutter in the process cartridge, that is, a second shutter, in accordance with the present invention, and its adjacencies.

Next, the operation for installing the process cartridge 1, structured as described above, into or from the apparatus main assembly will be described. The description will be given with reference to FIG. 6, which is an exploded perspective view of the second shutter, that is, the shutter on the process cartridge side, and its adjacencies. When the process cartridge 1 is outside the apparatus main assembly, the second shutter 18 is positioned at the angle indicated by the double dot chain line in FIG. 6, and the hole 18*a* is not aligned with the toner receiving hole 16, being therefore blocked.

As the process cartridge 1 is inserted into the apparatus main assembly, that is, as the process cartridge 1 is moved in the direction of axis Y in FIG. 2(*b*), the second shutter 18 moves, along with the main structure of the process cartridge 1, in the direction indicated by an arrow mark A. As a result, the projection 36 of the apparatus main assembly engages into the slot 18*b*, causing the shutter 18 to rotate 90° in the direction indicated by an arrow mark B as shown by the solid line in the drawing. Consequently, the hole 18*a* becomes aligned with the toner receiving hole 16, creating an unblocked passage between the two cartridges.

On the other hand, as the process cartridge 1 is removed from the apparatus main assembly, the second shutter 18 moves, along with the main structure of the process cartridge 1, in the direction opposite to the direction of the arrow mark A, being therefore rotated by 90° in the direction opposite to the direction of the arrow mark B, that is, the direction opposite to the direction in which it is rotated during its installation, by the projection 36. Consequently, the toner receiving hole 16 is blocked. In other words, the unblocking or blocking of the toner receiving hole 16 is directly linked to the movement of the process cartridge 1 while the process cartridge 1 is inserted into, or pulled out of, the apparatus main assembly.

(Operation for Installing or Removing Toner Cartridge)

Figure 7:
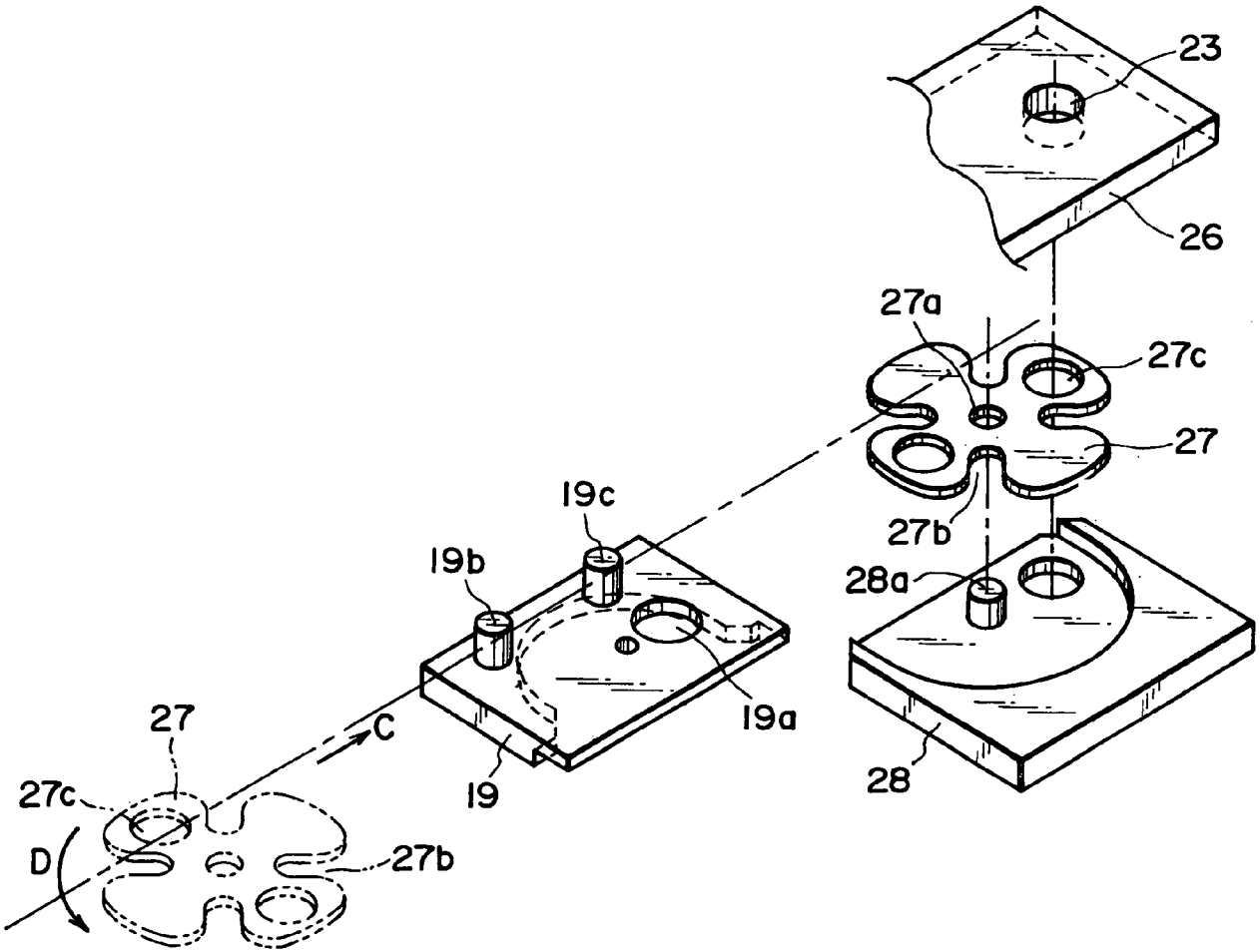
FIG. 7 is an exploded perspective view of the shutter in the toner cartridge, that is, the first shutter, and its adjacencies, in accordance with the present invention.

Next, the operation for installing, or removing, the toner cartridge 2 structured as described above into, or from, the apparatus main assembly will be described. The description will be given with reference to FIG. 7, which is an exploded perspective view of the first shutter, that is, the shutter on the toner cartridge side, and its adjacencies. When the toner cartridge 2 is outside the apparatus main assembly, the first shutter 27 is positioned at the angle indicated by the double dot chain line in FIG. 7. In other words, the hole 27*c* is not in alignment with the toner discharging hole 23, and therefore, the toner discharging hole 23 is blocked.

Figure 8:
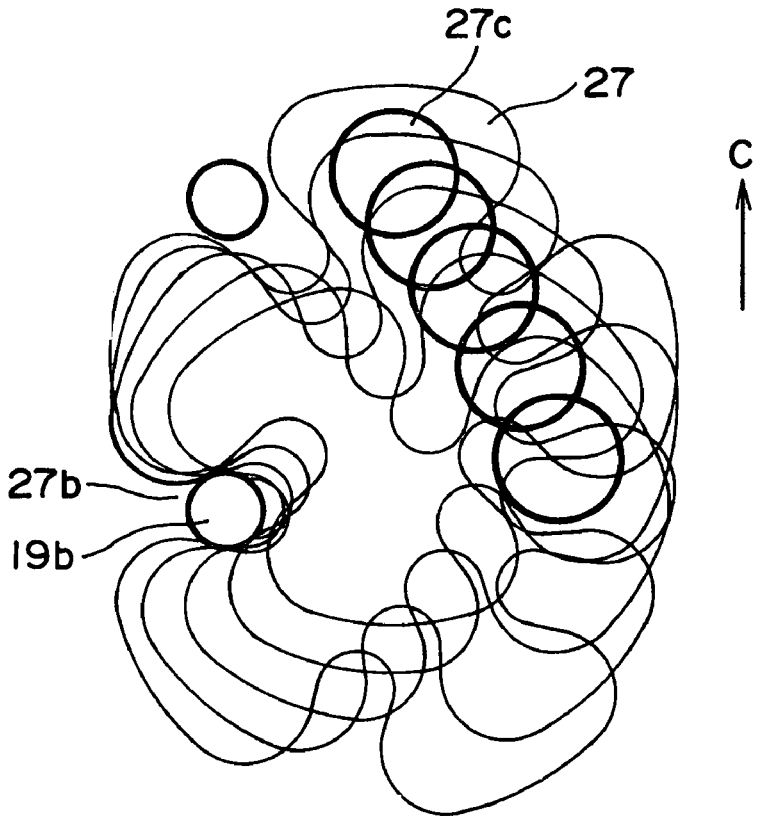
FIG. 8 is a top view of the toner cartridge, which shows the consecutive positions of the first shutter in its movement.

First, the movement of the first shutter 27 when the process cartridge 1 is already in the apparatus main assembly will be described. As the toner cartridge 2 is inserted into the apparatus main assembly, that is, as the toner cartridge 2 is moved in the direction of the Y axis in FIG. 2(*b*), the toner cartridge 2 approaches the process cartridge 1; the two cartridges move toward each other in relative terms. The first shutter 27 moves in the direction indicated by an arrow mark C. As a result, the projection 19*b*, that is, the force applying first portion of the shutter cover 19 engages into the slot 27*b* as the force receiving portion, causing the first shutter 27 to rotate 90° in the direction indicated by an arrow mark D as shown by the solid line in the drawing. Consequently, the hole 27*c* becomes aligned with the toner discharging hole 23, creating an unblocked passage between the two cartridges. FIG. 8 is a plan view of the top surface of the first shutter 27 and its adjacencies, showing the consecutive positions of the first shutter 27. As the first shutter 27 moves in the direction of the arrow mark C, the projection 19*b* engages into the slot 27*b*, causing the hole 27*c* to move to the position of the toner discharge hole 23.

Figure 9:
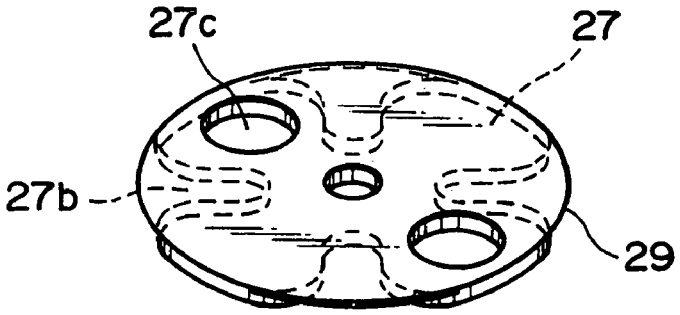
FIG. 9 is a perspective view of the first shutter in a form different from the preceding one.
Figure 10:
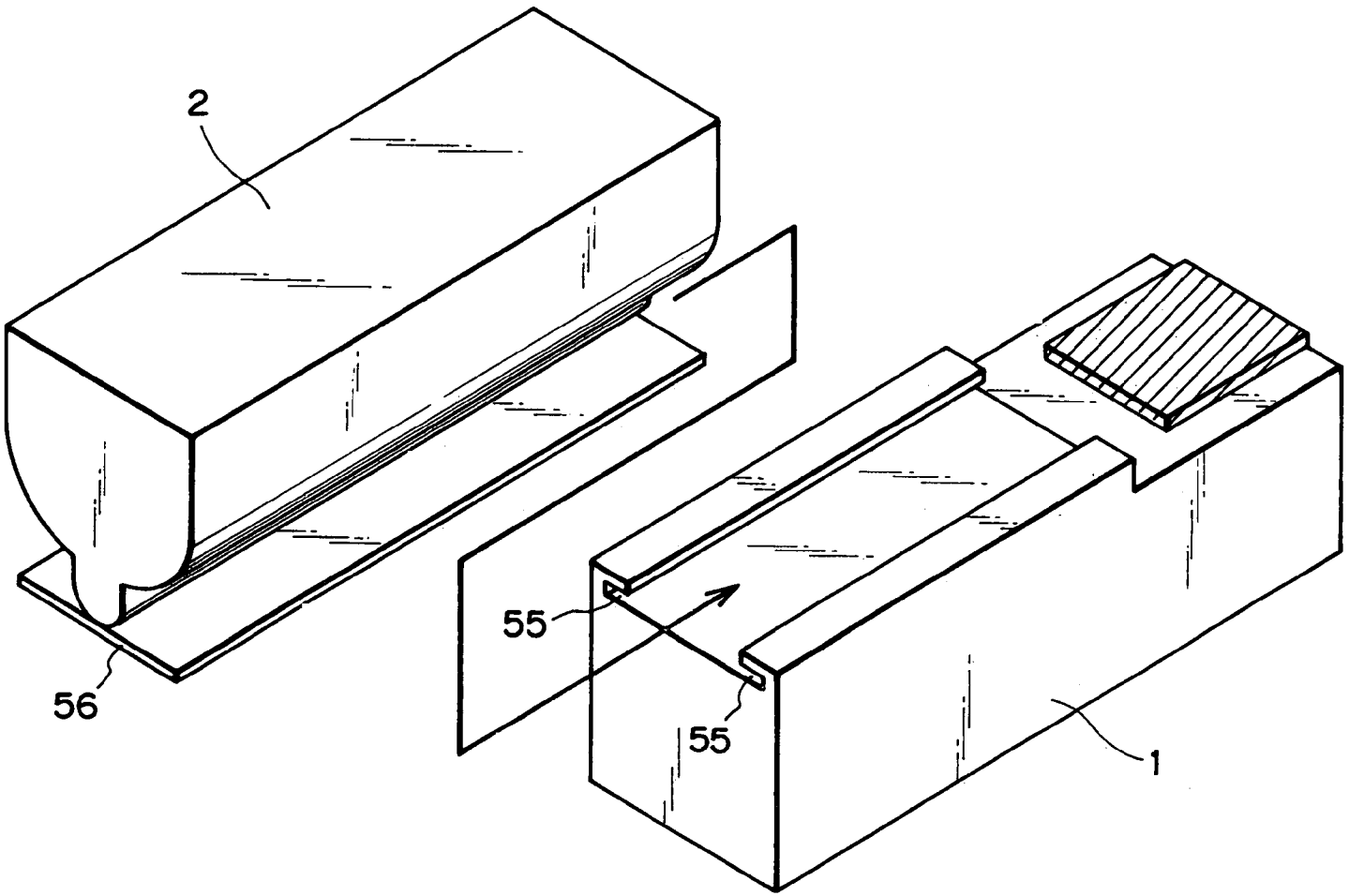
FIG. 10 is a perspective view of a combination of a process cartridge and a toner cartridge in accordance with the present invention, and shows a structural arrangement different from that in the preceding combination.
Figure 11:
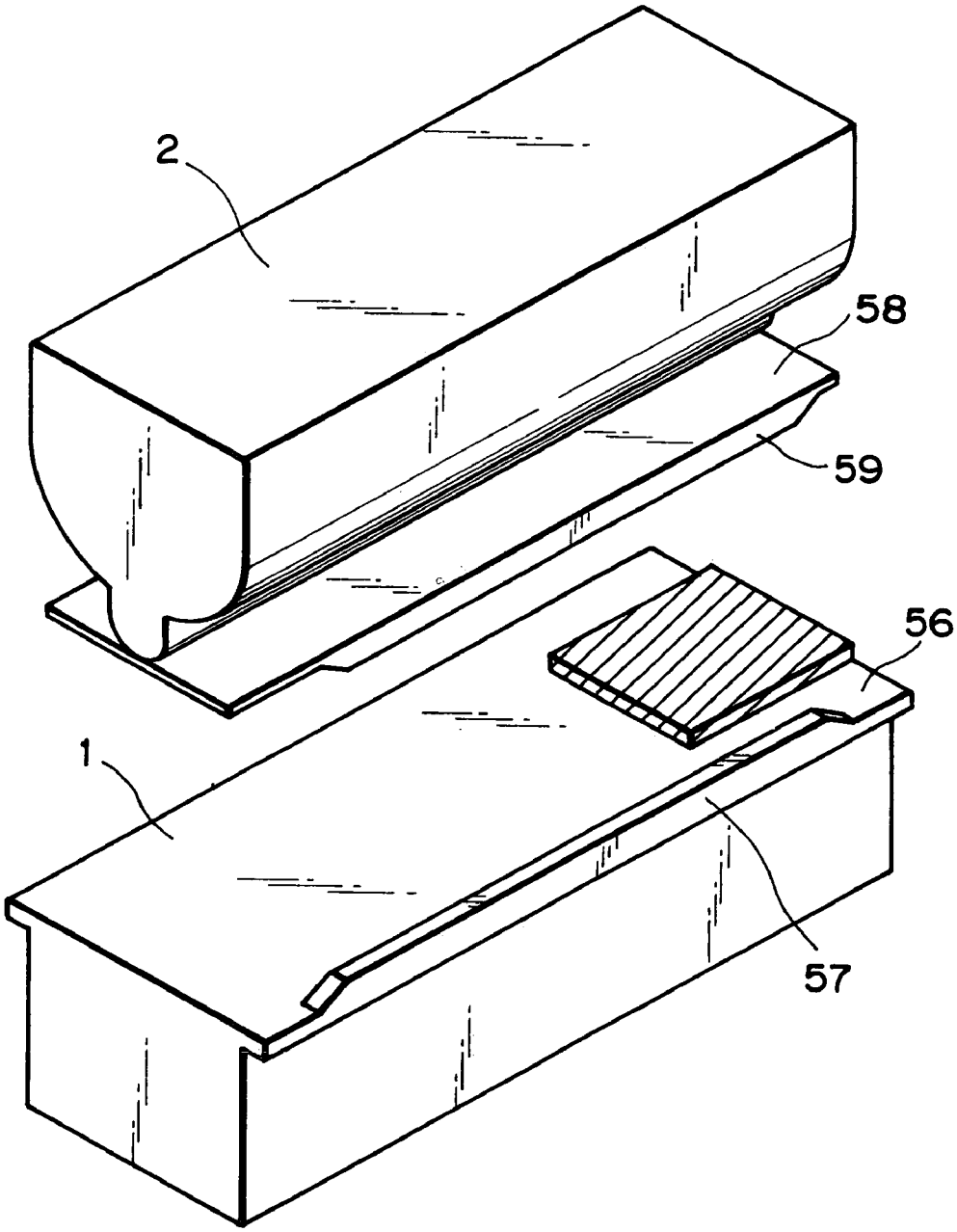
FIG. 11 is a perspective view of another combination of a process cartridge and a toner cartridge in accordance with the present invention, and shows a structural arrangement different from the preceding structural arrangements.

The slot 27*b* is open at both the top and bottom sides (in terms of the vertical direction of the drawing). However, a plate 29 may be placed in a manner to cover the top side of the slot 27*b* as shown in FIG. 9. With this provision of the plate 29, toner is prevented from falling and soiling the top surface of the process cartridge 1, and also from adhering to the adjacencies of the slot 27*b*, while the slot 27*b* passes the underside of the toner discharge hole 23. In other words, the provision of the plate 29 further reduces the scattering of toner.

As for the operation for removing the toner cartridge 2 from the apparatus main assembly which is holding both the process cartridge 1 and toner cartridge 2, as the toner cartridge 2 is pulled, the first shutter 27 moves in the direction opposite to the direction of the arrow mark C, while being rotated 90° by the projection 19*b* of the first shutter cover 19 in the direction opposite to the direction of the arrow mark D, that is, the direction in which it is rotated during its insertion. Consequently, the toner discharge hole 23 is blocked. In other words, as the two cartridges move away from each other in relative terms, force is applied to the first shutter 27 by the projection 19*b* in the direction to block the toner discharging hole 23.

Next, an operation in which the process cartridge 1 is not installed ahead of the toner cartridge 2, that is, an operation in which the process cartridge 1 is installed after the installation of the toner cartridge 2, will be described.

When the toner cartridge 2 is inserted into the apparatus main assembly ahead of the process cartridge 1, the first shutter 27 does not come into contact with the projection 19*b* for rotating the first shutter 27, and therefore, it remains in the closed position, in the main assembly. As the process cartridge 1 is inserted into the main assembly in this state, that is, the state in which the toner cartridge 2, the shutter 27 of which is in the closed position, is already in the main assembly, the projection 19*c*, that is, the force applying second portion, of the second shutter cover 19, engages into the slot 27*b* as the force receiving portion, causing the first shutter 27 to rotate 90°. As a result, the hole 27*c* aligns with the toner receiving hole 23, creating an unblocked passage between the two cartridges. When the process cartridge 1 is removed from the apparatus main assembly when the toner cartridge 2 is left in the apparatus main assembly, a reverse operation with respect to the above-described operation is carried out, blocking the toner discharging hole 23. In other words, the unblocking of the toner discharging hole 23 by the shutter 27 is directly linked to the movement of the toner cartridge 2 and process cartridge 1 toward each other in relative terms, and the blocking of the toner discharging hole 23 is directly linked to the movement of the toner cartridge 2 and process cartridge 1 away from each other in relative terms.

(Structure for Connecting Two Cartridges)

As described above, the opening or closing of the first shutter 27 is linked to the movement of the process cartridge 1 and toner cartridge 2 relative to each other in the direction (direction of axis Y) in which the process cartridge 1 or toner cartridge 2 is installed into, or removed from, the apparatus main assembly. Thus, the process cartridge 1 and toner cartridge 2 may be provided with a pair of grooves 55 as guiding portions, and a pair of ribs 56 as portions to be guided, respectively, so that the two cartridges are allowed to move only in the direction (direction of axis Y) in which they are installed into or removed from the apparatus main assembly. Engaging the ribs 56 into the grooves 55 prevents the two cartridges from separating in the vertical direction (direction of axis Z), which in turn makes it impossible to separate the process cartridge 1 and toner cartridge 2 from each other unless the two cartridges are moved relative to each other in the direction in which they are installed or removed, that is, unless the first shutter 27 is blocking the toner discharging hole 23.

Figure 12:
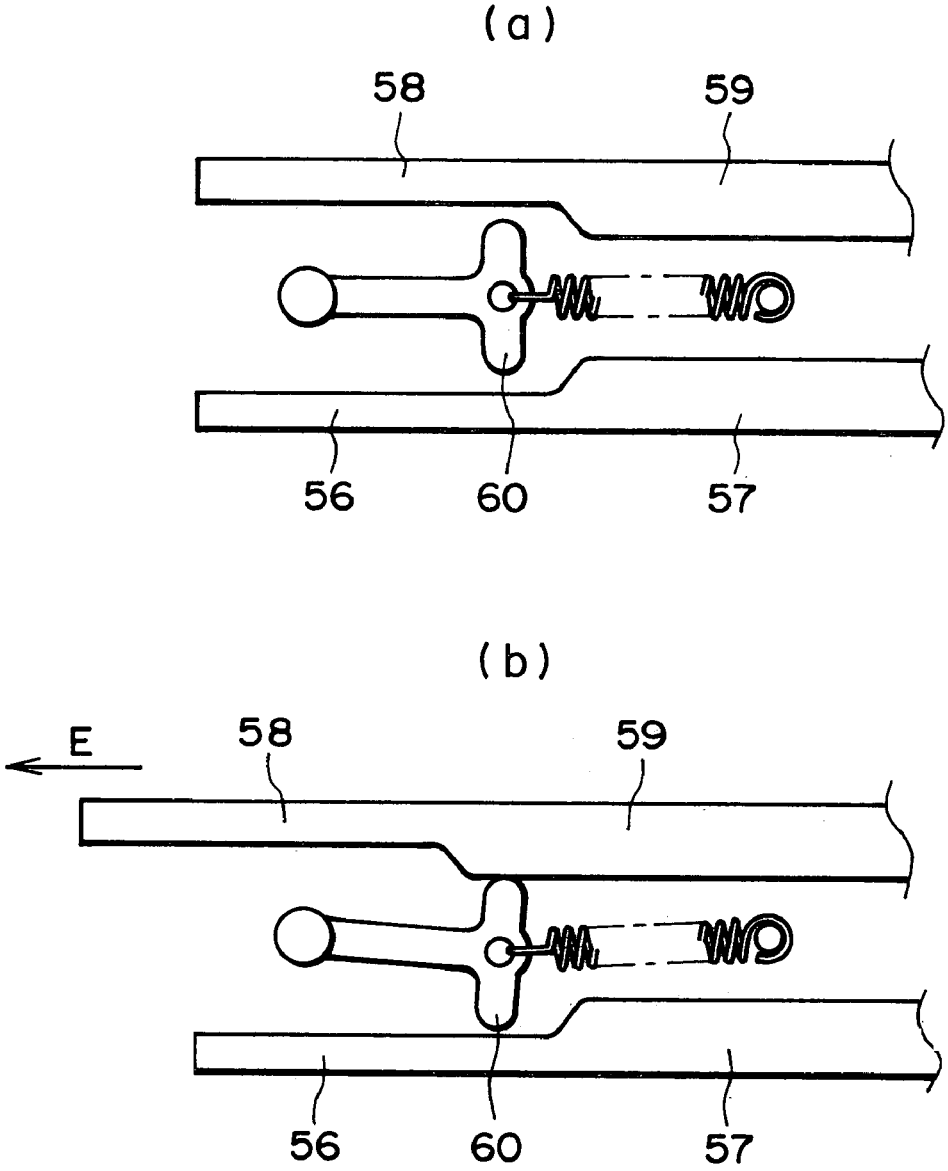
FIG. 12 is a schematic sectional view of a pivoting portion and its adjacencies, and shows the structures thereof.

Further, the ribs 56 and 58 of the toner cartridge 1 and process cartridge 2, that is, the portions by which the process cartridge 1 and toner cartridge 2 are guided when the process cartridge 1 and toner cartridge 2 are installed into the apparatus main assembly, respectively, may be provided with ribs 57 and 59, so that the two cartridges are prevented, by a pivoting member 60 as a removal controlling means illustrated in FIG. 12, from being removed at the same time.

More specifically, the pivoting member 60 is pivotally supported by the apparatus main assembly, and its widest portion in terms of the vertical direction of the drawing is rendered wider than the gap between the ribs 57 and 59 as shown in FIG. 12 (*b*). Thus, as the toner cartridge 2 is moved in the direction of an arrow mark E, the pivoting member is pressed down by the rib 59 of the toner cartridge 2, preventing thereby the rib 57 of the process cartridge 1 from moving in the direction of the arrow mark E. As a result, the process cartridge 1 is prevented from moving in the direction of the arrow mark E.

Since the first shutter 27 is provided with two holes 27*c* as described above, it is assured, regardless of the order in which the toner cartridge 2 and process cartridge 1 are installed or removed, that the first shutter 27 blocks the toner discharging hole 23 when the toner cartridge 2 or process cartridge 1 is removed from the apparatus main assembly. Further, the toner discharging hole 23 can be unblocked or blocked simply by the insertion or pulling, respectively, of the toner cartridge 2 into or out of the main assembly.

This embodiment of the present invention was described with reference to an electrophotographic color printer which employs four process cartridges 1 and four toner cartridges 2. However, the application of the present invention is not limited to such an image forming apparatus. For example, the application of the present invention to a monochromatic image forming apparatus also produces the same effects; in other words, the shutter for the toner discharge hole of the toner cartridge can be closed automatically simply by the movement of the process cartridge or toner cartridge which occurs during the installation or removal of the former or latter, that is, without the need for manually operating a lever or the like. Since the shutters are opened or closed by the movement of the cartridges which occurs during their installation or removal, without relying upon a pressure generating means such as a spring, the shutters are reliably opened or closed. It should be noted here that the aforementioned developer receiving cartridge may be such a developing cartridge that is not provided with a photosensitive member, a charging apparatus, and a cleaning apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developer supply container detachably mountable to an image forming apparatus, said container comprising:

a container body for containing a developer;

a discharge opening, provided in said container body, for permitting the discharge of the developer, wherein the developer discharged through said discharge opening is supplied to a developer receiving container which is disposed below said developer supply container and which is detachably mountable to the image forming apparatus; and a shutter member for opening and closing said discharge opening, wherein said shutter member is closed and opened by movement of said developer supply container relative to the developer receiving container, and wherein said shutter member is closed and opened by movement of the developer receiving container relative to said developer supply container.

2. A developer supply container according to claim 1, further comprising an engaging portion engageable with the developer receiving container, wherein said shutter member moves to open and close by a force received by said engaging portion from the developer receiving container resulting from the relative movement of said developer supply container relative to the developer receiving container.

3. A developer supply container according to claim 1 or 2, wherein said shutter member opens by the relative movement resulting from a mounting operation of said developer supply container to the image forming apparatus, and said shutter member closes by the relative movement resulting from a dismounting operation of said developer supply container from the image forming apparatus.

4. A developer supply container according to claim 1, wherein said developer supply container is detachably mountable to the image forming apparatus independently of the developer receiving container.

5. A developer supply container detachably mountable to an image forming apparatus, comprising:

a container body for containing a developer;

a discharging opening for permitting discharge of the developer from said container body, wherein the developer discharged through said discharging opening is supplied into a developer receiving container which is detachably mounted to the image forming apparatus;

a shutter member movable between an opening position for opening said discharging opening and a closing position for closing said discharging opening;

an engaging portion engageable with the developer receiving container, and wherein with said developer supply container being in place in the image forming apparatus, said shutter member is moved from the closing position to the opening position by said engaging portion receiving a force from the developer receiving container in response to a mounting operation for mounting the developer receiving container to the image forming apparatus, and wherein with the developer receiving container being in place in the image forming apparatus, said shutter member is moved from the closing position to the opening position by said engaging portion receiving a force from the developer receiving container in response to a mounting operation for mounting said developer supply container to the image forming apparatus.

6. A container according to claim 5, wherein said shutter member has an opening for fluid communication between said discharging opening and a receiving opening formed in the developer receiving container, and a shield portion for shielding said discharging opening.

7. A container according to claim 5, wherein said shutter member has a plurality of openings for fluid communication between said discharging opening and a receiving opening formed in the developer receiving container and a plurality of shield portions for shielding said discharging opening, arranged alternately with respect to a rotational direction of said shutter member.

8. A container according to claim 7, wherein said shutter member has a pair of openings for fluid communication between said discharging opening and the receiving opening which are diametrically opposed to each other, and a pair of shield portions which are diametrically opposed to each other.

9. A container according to claim 8, wherein said engaging portion is provided at each of a position between one of the openings and one of the shield portions and a position between the other of the openings and the other of the shield portions, with respect to the rotational direction.

10. A container according to claim 9, wherein said shutter member is rotatable between the opening position and the closing position through engagement between either one of said engaging portions and the developer receiving container.

11. A container according to claim 10, wherein said engaging portion is in the form of a recess engageable with a projection provided in the developer receiving container.

12. A container according to claim 11, wherein said shutter member includes a shielding plate, for covering said recess, provided at a container body side, wherein said shielding plate has an opening in fluid communication with said discharging opening, and wherein said developer supply container is mounted at a position above the developer receiving container.

13. A container according to claim 5 or 11, wherein with said developer supply container and the developer receiving container being in place in the image forming apparatus, said shutter member is moved from the opening position to the closing position in response to a dismounting operation of either said developer supply container or the developer receiving container from the image forming apparatus.

14. A container according to claim 5, wherein mounting and dismounting directions of said developer supply container and the developer receiving container relative to the image forming apparatus are substantially parallel with each other.

15. A container according to claim 5, wherein said developer supply container is disposed above the developer receiving container.

16. A container according to claim 15, wherein said developer supply container has a guide portion for being guided by the developer receiving container in a mounting direction thereof, wherein said guide portion is effective to prevent said developer supply container from being moved away from the developer receiving container in a direction perpendicular to the mounting direction.

17. A container according to claim 5, further comprising limiting means for preventing simultaneous removal of said developer supply container and the developer receiving container from the image forming apparatus.

18. A developer supply container detachably mountable to an image forming apparatus, comprising:

a container body for containing a developer;

a discharging opening for permitting discharge of the developer from said container body, wherein the developer discharged through said discharging opening is supplied into a developer receiving container which is detachably mountable to the image forming apparatus;

a shutter member movable between an opening position for opening said discharging opening and a closing position for closing said discharging opening; and an engaging portion engageable with the developer receiving container, wherein with said developer supply container and the developer receiving container being in place in the image forming apparatus, said shutter member is moved from the opening position to the closing position by said engaging portion receiving a force from the developer receiving container in response to a dismounting operation of said developer supply container from the image forming apparatus, and wherein with said developer supply container and the developer receiving container being in place in the image forming apparatus, said shutter member is moved from the opening position to the closing position by said engaging portion receiving a force from the developer receiving container in response to a dismounting operation of the developer receiving container from the image forming apparatus.

19. A container according to claim 18, wherein said shutter member has an opening for fluid communication between said discharging opening and a receiving opening formed in the developer receiving container, and a shield portion for shielding said discharging opening.

20. A container according to claim 18, wherein said shutter member has a plurality of openings for fluid communication between said discharging opening and a receiving opening formed in the developer receiving container and a plurality of shield portions for shielding said discharging opening, arranged alternately with respect to a rotational direction of said shutter member.

21. A container according to claim 20, wherein said shutter member has a pair of openings for fluid communication between said discharging opening and the receiving opening which are diametrically opposed to each other, and a pair of shield portions which are diametrically opposed to each other.

22. A container according to claim 21, wherein said engaging portion is provided at each of a position between one of the openings and one of said shield portions and a position between the other one of the openings and the other of the shield portions, with respect to the rotational direction.

23. A container according to claim 22, wherein said shutter member is rotatable between the opening position and the closing position through engagement between either one of said engaging portions and the developer receiving container.

24. A container according to claim 23, wherein said engaging portion is in the form of a recess engageable with a projection provided in the developer receiving container.

25. A container according to claim 24, wherein said shutter member includes a shielding plate, for covering said recess, provided at a container body side, wherein said shielding plate has an opening in fluid communication with said discharging opening, and wherein said developer supply container is mounted at a position above the developer receiving container.

26. A container according to claim 18, wherein mounting and dismounting directions of said developer supply container and the developer receiving container relative to the image forming apparatus are substantially parallel with each other.

27. A container according to claim 18, wherein said developer supply container is disposed above the developer receiving container.

28. A container according to claim 27, wherein said developer supply container has a guide portion for being guided by the developer receiving container in a mounting direction thereof, and wherein said guide portion is effective to prevent said developer supply container from being moved away from the developer receiving container in a direction perpendicular to the mounting direction.

29. A container according to claim 18, further comprising limiting means for preventing simultaneous removal of said developer supply container and the developer receiving container from the image forming apparatus.

30. A container according to claim 18, wherein the developer receiving container includes developing means for developing an electrostatic latent image formed on an image bearing member of the image forming apparatus.

31. A toner cartridge for supplying toner into a process cartridge having a developing device, said toner cartridge being detachably mountable to an image forming apparatus, said toner cartridge comprising:

a container for containing toner;

a discharge opening, provided in said container, for permitting discharging of the toner, wherein the toner discharged through said discharge opening is supplied into the process cartridge mounted detachably to the image forming apparatus; and a shutter member movable between an open position for opening said discharge opening and a close position for closing said discharge opening, wherein said shutter member has an engaging portion for engagement with the process cartridge, wherein in a state wherein said toner cartridge is mounted to the image forming apparatus, said shutter member is moved from the close position to the open position by said engaging portion receiving a force from the process cartridge in response to an operation of mounting the process cartridge to the image forming apparatus, and wherein in a state wherein the process cartridge is mounted to the image forming apparatus, said shutter member is moved from the close position to the open position by said engaging portion receiving a force from the process cartridge in response to an operation of mounting said toner cartridge to the image forming apparatus.

32. A toner cartridge according to claim 31, wherein in a state wherein said toner cartridge and the process cartridge are both mounted to the image forming apparatus, said shutter member is moved from the open position to the close position by said engaging portion receiving a force from the process cartridge in response to an operation of dismounting either said toner cartridge or the process cartridge from the image forming apparatus.

33. A toner cartridge according to claim 31, wherein said toner cartridge is detachably mountable to the image forming apparatus independently of the process cartridge.

34. A toner cartridge supplying toner into a process cartridge having a developing device, said toner cartridge being detachably mountable to an image forming apparatus, said toner cartridge comprising:

a container for containing toner;

a discharge opening, provided in said container, for permitting discharging of the toner, wherein the toner discharged through said discharge opening is supplied into the process cartridge mounted detachably to the image forming apparatus; and a shutter member for opening and closing said discharge opening;

wherein said shutter member has an engaging portion for engagement with the process cartridge, wherein in a state wherein both of said toner cartridge and the process cartridge are mounted to the image forming apparatus, said shutter member is moved from the open position to the close position by said engaging portion receiving a force from the process cartridge in response to an operation of dismounting said toner cartridge from the image forming apparatus, and wherein in a state wherein both of said toner cartridge and the process cartridge are mounted to the image forming apparatus, said shutter member is moved from the open position to the close position by said engaging portion receiving a force from the process cartridge in response to an operation of dismounting the process cartridge from the image forming apparatus.

35. A toner cartridge according to claim 34, wherein said toner cartridge is detachably mountable to the image forming apparatus independently of the process cartridge.

36. A toner cartridge for supplying toner into a process cartridge having a developing device, said toner cartridge being detachably mountable to an image forming apparatus, said toner cartridge comprising:

a container body for containing a developer;

a discharge opening, provided in said container body, for permitting discharging of the developer, wherein the developer discharged through said discharge opening is supplied to a process cartridge which is disposed below said container body and which is detachably mountable to the image forming apparatus; and a shutter member for opening and closing said discharge opening, wherein said shutter member is closed and opened by movement of said toner cartridge relative to the process cartridge, and wherein said shutter member is closed and opened by movement of the process cartridge relative to said toner cartridge.

37. A toner cartridge according to claim 36, further comprising an engaging portion engageable with the process cartridge, wherein said shutter member moves to open and close by said engaging portion receiving a force from the process cartridge by the relative movement of said toner cartridge relative to the process cartridge.

38. A toner cartridge according to claim 36 or 37, wherein said shutter member is opened by the relative movement resulting from the mounting operation of said toner cartridge to the image forming apparatus, and said shutter member is closed by the relative movement resulting from the dismounting operation of said toner cartridge from the image forming apparatus.

39. A toner cartridge according to claim 36, wherein said toner cartridge is detachably mountable to the image forming apparatus independently of the process cartridge.

* * * * *

UNITED STATES PATENT AND TRADEMARK OFFICE

CERTIFICATE OF CORRECTION

PATENT NO. : 7,010,250 B1
APPLICATION NO. : 09/718416
DATED : March 7, 2006
INVENTOR(S) : Takashi Yahagi It is certified that error appears in the above-identified patent and that said Letters Patent is hereby corrected as shown below:

ON THE COVER PAGE

At Item (30), Foreign Application Priority Data, "11/337265" should read --11-337265--, and "2000/350621" should read --2000-350621--.

COLUMN 4

Line 21, "with tone." should read --with toner.--.
Line 28, "drums 100-1d." should read --drums 100-10d.--.

Signed and Sealed this

Twenty-seventh Day of January, 2009

JOHN DOLL
*Acting Director of the United States Patent and Trademark Office*